US009957668B2

(12) United States Patent
Lichtberger

(10) Patent No.: US 9,957,668 B2
(45) Date of Patent: May 1, 2018

(54) TAMPING UNIT FOR A TRACK TAMPING MACHINE

(71) Applicant: System 7—Railsupport GmbH, Vienna (AT)

(72) Inventor: Bernhard Lichtberger, Pregarten (AT)

(73) Assignee: System 7-Railsupport GmbH, Vienna (AT)

( * ) Notice: Subject to any disclaimer, the term of this patent is extended or adjusted under 35 U.S.C. 154(b) by 183 days.

(21) Appl. No.: 14/769,585

(22) PCT Filed: Jan. 22, 2014

(86) PCT No.: PCT/AT2014/050027
§ 371 (c)(1),
(2) Date: Aug. 21, 2015

(87) PCT Pub. No.: WO2014/127393
PCT Pub. Date: Aug. 28, 2014

(65) Prior Publication Data

US 2016/0010287 A1 Jan. 14, 2016

(30) Foreign Application Priority Data

Feb. 22, 2013 (AT) ..... A 50121/2013
Mar. 25, 2013 (EP) ..... 13160788

(51) Int. Cl.
*E01B 27/16* (2006.01)

(52) U.S. Cl.
CPC ..... *E01B 27/16* (2013.01)

(58) Field of Classification Search
CPC ..... E01B 27/17; E01B 2203/10; E01B 35/00; E01B 27/20; E01B 2203/125;
(Continued)

(56) References Cited

U.S. PATENT DOCUMENTS 3,735,708 A * 5/1973 Plasser ..... B06B 1/183 104/12
3,807,311 A * 4/1974 Plasser ..... E01B 27/17 104/12

(Continued)

FOREIGN PATENT DOCUMENTS

AT 369455 1/1983
DE 2424829 1/1976

(Continued)

OTHER PUBLICATIONS

Espacenet. English language abstract for DE 2424829 A1 (Jan. 8, 1976). Bernhard-Heinz Boeker.

(Continued)

*Primary Examiner* — Mark T Le
(74) *Attorney, Agent, or Firm* — Tiajoloff & Kelly LLP

(57) ABSTRACT

A tamping assembly for a track tamping machine has a pair of tamping tools arranged on a carrier (2) so it is vertically adjustable in a tamping assembly frame and is designed as a rocker arm, the lower tamping pick ends (5) of which, which plunge into a ballast bed (4), are drivable in opposite directions using an oscillation drive (6) and can be fed hydraulically toward one another. To increase the stability of the tamping assembly, a hydraulic cylinder (11) and a distance sensor (12) for determining the hydraulic cylinder position are associated with each of the tamping tools (3) of a tamping tool pair, wherein the hydraulic cylinders (11) form the feed drive and also the oscillation drive (6) of the tamping tools (3) and the hydraulic cylinders (11) are activated in dependence on the distance sensor signal.

5 Claims, 2 Drawing Sheets

(58) Field of Classification Search
CPC ..... E01B 27/00; E01B 29/04; E01B 1/001; E01B 2203/12; E01B 2203/127; E01B 27/16
USPC ..... 104/10, 12
See application file for complete search history.

(56) References Cited

U.S. PATENT DOCUMENTS 4,092,903 A 6/1978 Allmer
4,096,806 A 6/1978 Allmer
4,423,684 A * 1/1984 Theurer ..... E01B 27/17 104/12
5,591,915 A 1/1997 Theurer et al.
2002/0170329 A1* 11/2002 Ichiryu ..... B21D 7/025 72/166
2002/0170424 A1* 11/2002 Brown ..... F15B 15/2869 92/5 R
2006/0090666 A1* 5/2006 Theurer ..... E01B 27/16 104/12

FOREIGN PATENT DOCUMENTS

EP 0688902 A1 12/1995
EP 1653003 A2 5/2006

OTHER PUBLICATIONS

Espacenet English language abstract for DE 2424829 A1 (Jan. 8, 1976).

* cited by examiner

TAMPING UNIT FOR A TRACK TAMPING MACHINE

FIELD OF THE INVENTION

The invention relates to a tamping unit for a track tamping machine having a pair of tamping tools, which are guided so they are vertically adjustable in a tamping assembly frame, are arranged on a carrier, and are designed as rocker arms, the lower tamping pick ends of which, which are intended to plunge into a ballast bed, are drivable in opposite directions using an oscillation drive and can be hydraulically fed toward one another.

DESCRIPTION OF THE PRIOR ART

Tamping assemblies penetrate the ballast of a track bed using tamping tools in the region between two sleepers (intermediate compartment), in the region of the support of the sleeper in the ballast under the rail, and compact the ballast by way of a dynamic vibration of the tamping picks between the tamping picks, which can be fed toward one another. Tamping assemblies can tamp one, two, or more sleepers in one work cycle (DE 24 24 829 A).

The movements of a tamping assembly comprise the vertical plunging of the tamping picks into the ballast, the feed movement, during which the tamping pick ends are closed toward one another, and the superimposed dynamic oscillation which causes the actual compaction of the ballast grains. Using hydraulic cylinders for the feed movement is known, which are connected via connecting rods to a vibration shaft with eccentricity and which superimpose the vibrational oscillation on the feed movement (AT 369 455 B). These vibration shafts and connecting rods are mounted via roller bearings, which require regular costly maintenance. Other known solutions use a linear excitation via hydraulic cylinders. In this case, two hydraulic cylinders are mechanically coupled in series. One hydraulic cylinder executes the feed movement, and the other the vibrational movement. The dimension of the oscillation arising in this case is determined mechanically and by the hydraulic excitation. The dimension of the amplitude cannot be set freely.

Optimum tamping frequencies for compacting are known to be between 25-40 Hz, wherein penetration of the tamping picks into the ballast is more easily possible at higher frequencies, since only a lesser plunging impact occurs, and therefore the strain of the mounts of the tamping pick assembly can be reduced.

The tamping assemblies presently used have a very high and costly level of maintenance. The assemblies are typically at least partially overhauled and maintained every season. After 1 to 2 overhauls, the assemblies must be replaced by new ones. In addition, equipping tamping assemblies having rotating vibration shafts with a flywheel is known, so that the frequency does not drop excessively with increasing compaction of the ballast. It is also known that during the activation of the feed cylinders, the amplitude decreases due to the elasticity of the hydraulic hoses and therefore the compaction effect is reduced. It is known from various studies that decreasing tamping amplitudes contribute to the compaction and also reduce the penetration into the ballast.

SUMMARY OF THE INVENTION

The invention is therefore based on the object of refining tamping assemblies of the type described at the outset using simple means such that the stability of the vibration drive is substantially increased.

The invention achieves the stated object in that a hydraulic cylinder and a distance sensor for determining the hydraulic cylinder position are associated with each of the tamping tools of a pair of tamping tools, wherein the hydraulic cylinders form the feed drive and also the oscillation drive of the tamping picks and the hydraulic cylinders are activated in dependence on the distance sensor signal.

According to the invention, a single shared hydraulic cylinder is used for the feed movement and the vibrational movement of at least one tamping pick (optionally also multiple tamping picks of multiple pairs of tamping picks which are driven synchronously). A measurement encoder is associated with the hydraulic cylinder, which always detects the precise position of the hydraulic piston, for example. Since no rotating parts are provided in the power stage of the drive, in contrast to the prior art, the stability of the vibration drive is substantially improved with extremely simple construction.

Particularly robust construction conditions, which are thus less susceptible to failure and are simple, result if the distance sensor and the hydraulic cylinder form a module and the distance sensor is integrated in the hydraulic cylinder in particular.

Hydraulic cylinder activation valves, in particular servo valves or proportional valves, which are arranged directly on the hydraulic cylinder, are advantageous for actuating the hydraulic cylinder. The hydraulic lines are to be as short as possible, so that the elasticity, that is the storage action (damping) of the hydraulic hoses under the shock load, is kept low. Typical requirements are amplitudes of 3-6 mm at the tamping pick ends at a maximum frequency of 50 Hz. Compaction amplitudes close to the upper limit are better suitable, for example, for looser ballast (after track cleaning and track renovation or new track construction).

For the tamping, the present hydraulic cylinder position is detected by the distance sensor, which is installed in the hydraulic cylinder or attached externally. Any suitable measurement sensor which takes over the function can be used. The detected position is compared to a setpoint position, for example, and the respective hydraulic cylinder activation valve is activated accordingly using the difference, for which a controller or regulator is provided. The hydraulic cylinder position can thus be specified or regulated by a controller/regulator in dependence on the distance sensor signals, wherein an oscillation can be superimposed on a linear feed movement of the hydraulic cylinders in particular.

The controller/regulator specifies the oscillation, the oscillation amplitude, and the oscillation frequency in dependence on the height location and the feed location of the tamping pick ends. The setpoint position is specified by an electrical signal curve. A linearly rising voltage (ramp) is specified for a linear feed movement for this purpose, for example. The opening width of the tamping assembly, that is the spacing of the tamping pick ends of a tamping pick pair, corresponds in this case to a defined specified voltage. The oscillation in turn corresponds to an AC voltage overlaid on the feed voltage. The amplitude of the AC voltage then corresponds to the vibration amplitude and the frequency of the AC voltage corresponds to the tamping frequency.

The essential advantages of the invention are the simple construction, which manages, without wear-susceptible roller bearings, connecting rods, and connecting rod mounts, the coupling of the feed cylinder to the vibration shaft and does not require a flywheel. In addition, the tamping assembly opening width, i.e., the spacing between the tamping pick ends, is continuously adjustable and it is possible to freely specify the tamping frequency arbitrarily, for example, plunging of the picks at 50 Hz for a low plunging impact and compaction at 35 Hz in the working position of the picks to reduce the wear and the noise, without problems. Continuous adjustment of the tamping amplitude and the signal form thereof (rectangular, sinusoidal, triangular, saw-tooth) enables optimum adaptation to the respective superstructure conditions. If a control loop is provided, the tamping movement is automatically readjusted in the event of resistance changes by the control loop, wherein it is ensured that the desired tamping amplitudes and frequencies are maintained.

The feed distance is typically specified by the controller/regulator. However, if the ballast is already highly compacted, the actual movement will then necessarily deviate from the setpoint movement. To nonetheless then be able to compact the ballast in a targeted manner, it is advisable if the controller/regulator specifies the oscillation, the oscillation amplitude, and the oscillation frequency in dependence on a cylinder pressure, which is measured using a pressure sensor in particular. The compaction of the ballast bed can thus be inferred by way of a pressure measurement in the hydraulic cylinder.

Various operating modes of the tamping assemblies or the single pick systems are possible using the invention, in particular different frequencies, different amplitudes, and the like for various tamping picks. Recording the actual distances and the setpoint distances of the tamping assembly is possible in a simple manner by capturing measured values, whereby a quality control of the achieved compaction is possible. Statements about the state of the ballast bed (loose, encrusted, soiled) are thus also possible. A change of the ballast bed conditions can be reacted to immediately and automatically. The feed speed can thus be elevated at the beginning and the amplitude can also be increased in a looser bed. If the bed becomes denser due to the tamping, amplitude and frequency can be continuously readjusted.

BRIEF DESCRIPTION OF THE DRAWING

The subject matter of the invention is illustrated as an example in the drawing. In the figures

DESCRIPTION OF THE PREFERRED EMBODIMENT

Figure 1:
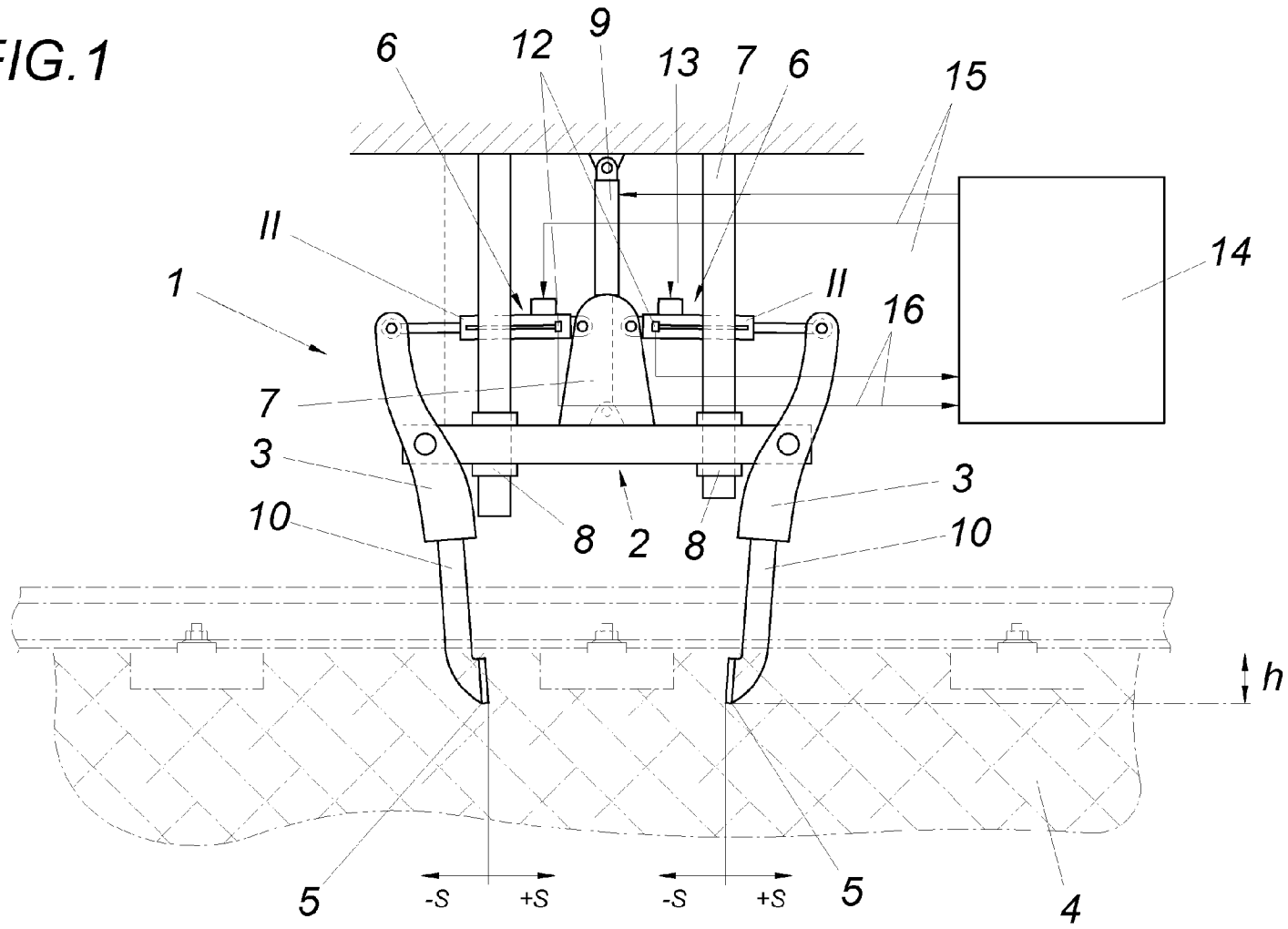
FIG. 1 shows a tamping assembly according to the invention in a side view in partial section and FIG. 2 shows a diagram to illustrate the feed location of the tamping tools.

A tamping assembly 1 for a track tamping machine comprises, inter alia, a pair of tamping tools, which is arranged on a carrier 2 and is designed as a rocker arm, having tamping tools 3, the lower tamping pick ends 5 of which, which are intended to plunge into a ballast bed 4, are drivable in opposite directions using an oscillation drive 6 and can be fed hydraulically toward one another, with a feed distance s. The carrier 2 is guided so it is vertically adjustable in a tamping assembly frame 7 having guides 8 and is displaceable into the desired vertical location using a positioning cylinder 9. The tamping tools 3 are designed as two-armed levers, which are mounted so they are pivotable on the carrier 2. One arm of the respective tamping tool 3 is formed by a tamping pick 10 and a hydraulic cylinder 11 engages on the other arm, which is in turn mounted at the other end on the carrier 2.

A hydraulic cylinder 11 and a distance sensor 12 for determining the hydraulic cylinder position are associated with each of the tamping tools 3 of a pair of tamping tools, wherein the hydraulic cylinders 11 form the feed drive and also the oscillation drive for the tamping picks 10 and the activation of the hydraulic cylinders 11 is performed in dependence on the distance sensor signal. Therefore, the exact stroke location of the hydraulic cylinder 11, i.e., the spacing between its two linkage points, on one end on the tamping tool 3 and on the other end on the carrier 2, can always be determined using the distance sensor 12. In the exemplary embodiment, the distance sensor 12 and a hydraulic cylinder 11 form a module and the distance sensor 12 is integrated in the hydraulic cylinder 11.

Hydraulic cylinder activation valves 13, in particular servo valves or proportional valves, which are arranged directly on the hydraulic cylinder 11, are provided for actuating the hydraulic cylinder. The supply lines of the hydraulics, i.e., the pump lines and the tank lines, are not shown for the sake of comprehensibility. The supply of the tamping assembly with hydraulic energy is performed via a typical hydraulic assembly.

Figure 2:
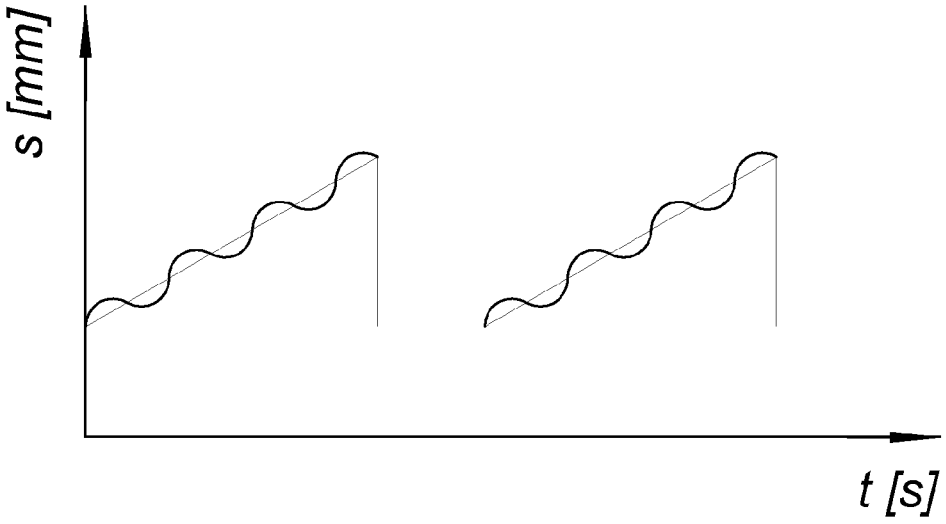

The hydraulic cylinder position can be specified by a controller/regulator 14 in dependence on the distance sensor signals. For this purpose, the controller/regulator 14 is connected via control lines 15 to the hydraulic cylinder activation valves 13 and via measurement lines 16 to the distance sensors 12. The controller/regulator 14 can specify the oscillation, i.e., the oscillation amplitude and oscillation frequency, in dependence on the height location h and the feed location s of the tamping picks 10. The feed s and the oscillation excitation of the tamping picks 10 are therefore performed by a hydraulic cylinder, wherein one hydraulic cylinder 11 is provided for each tamping pick 10, or also one hydraulic cylinder 11 can also be provided for multiple tamping picks 10 to be moved synchronously. FIG. 2 shows that an oscillation can be superimposed on a linear feed movement of the hydraulic cylinders 11.

The invention claimed is:

1. A tamping assembly for a track tamping machine, said tamping assembly comprising:

a pair of tamping tools arranged on a carrier so as to be vertically adjustable in a tamping assembly frame, said tamping tools each comprising a respective rocker arm having a lower tamping pick end, said lower tamping pick ends being configured to plunge into a ballast bed, and being drivable in opposite directions using an oscillation drive, wherein said tamping pick ends can be fed hydraulically toward one another, wherein a respective hydraulic cylinder and a respective distance sensor determining a position of the respective hydraulic cylinder are associated with each of the tamping tools of the tamping tool pair, and wherein the hydraulic cylinders form a feed drive and also the oscillation drive of the tamping tools, and the hydraulic cylinders are each activated responsive to a respective signal from the respective distance sensor; and wherein the hydraulic cylinders are each actuated by respective hydraulic cylinder activation valves, which are each arranged directly on the respective hydraulic cylinder;

wherein an oscillation is superimposed on a linear feed movement of the hydraulic cylinders;

wherein a controller/regulator specifies the oscillation, including an oscillation amplitude and an oscillation frequency, based on a cylinder pressure, which is measured using a pressure sensor.

2. The tamping assembly according to claim 1, wherein the distance sensor and the hydraulic cylinder form a module and the distance sensor is integrated in the hydraulic cylinder.

3. The tamping assembly according to claim 1, wherein each of the hydraulic cylinders has a respective position that is determined by the controller/regulator responsive to the respective signal from the respective distance sensor.

4. The tamping assembly according to claim 3, wherein the controller/regulator specifies said oscillation, said oscillation amplitude, and said oscillation frequency based on a vertical location and a feed location (±h, ±s) of the tamping tools.

5. The tamping assembly according to claim 1, wherein the hydraulic cylinder activation valves comprise servo valves or proportional valves.

* * * * *